US009322397B2

(12) United States Patent
Burnette

(10) Patent No.: US 9,322,397 B2
(45) Date of Patent: Apr. 26, 2016

(54) FRACTURING PUMP ASSEMBLY AND METHOD THEREOF

(71) Applicant: Blake Burnette, Tomball, TX (US)

(72) Inventor: Blake Burnette, Tomball, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 360 days.

(21) Appl. No.: 13/787,378

(22) Filed: Mar. 6, 2013

(65) Prior Publication Data

US 2014/0255214 A1 Sep. 11, 2014

(51) Int. Cl.

| | |
|---|---|
| ***F04B 9/107*** | (2006.01) |
| ***F04B 23/06*** | (2006.01) |
| ***F15B 15/04*** | (2006.01) |
| ***E21B 43/26*** | (2006.01) |
| ***F04B 17/03*** | (2006.01) |

(52) U.S. Cl.

CPC ..... *F04B 9/107* (2013.01); *E21B 43/26* (2013.01); *F04B 17/03* (2013.01); *F04B 23/06* (2013.01); *F15B 15/04* (2013.01)

(58) Field of Classification Search

CPC ..... F04B 9/02; F04B 9/025; F04B 9/10; F04B 9/103; F04B 9/107; F04B 47/02; F04B 47/04; F04B 23/06; F04B 35/01; F04B 35/04; F04B 15/02; F04B 17/03; E21B 43/25; E21B 43/17; E21B 34/10; E21B 43/26; E21B 34/106; F15B 15/038; F15B 7/001; F15B 15/04; F15B 47/001

USPC ..... 417/225, 226, 400; 92/136; 60/545, 567

See application file for complete search history.

(56) References Cited

U.S. PATENT DOCUMENTS

| | | | | |
|---|---|---|---|---|
| 1,956,074 | A * | 4/1934 | Krause | F16N 3/12 222/256 |
| 2,463,552 | A | 3/1949 | Newhall | |
| 3,244,022 | A | 4/1966 | Wysong, Jr. | |
| 3,386,345 | A * | 6/1968 | Taplin | 92/99 |
| 3,773,438 | A | 11/1973 | Hall et al. | |
| 4,276,003 | A * | 6/1981 | Perkins et al. | 417/415 |
| 4,493,614 | A * | 1/1985 | Chu et al. | 417/22 |
| 4,566,868 | A * | 1/1986 | Menzies | 417/572 |
| 4,576,064 | A * | 3/1986 | Kentfield | 74/833 |
| 6,289,998 | B1 | 9/2001 | Krueger et al. | |
| 6,748,816 | B2 | 6/2004 | Rogers, Jr. et al. | |

OTHER PUBLICATIONS

Halliburton, "The MV Skandi Fjord and the Skandi Team", Unmatched North Sea Stimulation Capabilities, Production Enhancement, www.halliburton.com, H00159 09/10, 2010 Halliburton, pp. 1-8.

Harold Labyer, et al. Halliburton Services, "Ultra-Large Internsifier Pump for High Pressure Well Stimulation", SPE 4679, 48th Annual Fall Meeting of the Society of Petroleum Engineers of AIME, Leg Vegas, Nev., Sep. 30-Oct. 3, 1973, pp. 1-8.

* cited by examiner

*Primary Examiner* — Devon Kramer
*Assistant Examiner* — Kenneth J Hansen
(74) *Attorney, Agent, or Firm* — Cantor Colburn LLP

(57) ABSTRACT

A fracturing pump assembly includes an intensifier including a hydraulic cylinder, a compression member arranged within the hydraulic cylinder and a rotatable member, wherein the compression member is linearly actuated within the hydraulic cylinder by rotation of the rotatable member.

18 Claims, 6 Drawing Sheets

FRACTURING PUMP ASSEMBLY AND METHOD THEREOF

BACKGROUND

In the drilling and completion industry, the formation of boreholes for the purpose of production or injection of fluid is common The boreholes are used for exploration or extraction of natural resources such as hydrocarbons, oil, gas, water, and alternatively for CO2 sequestration. To increase the production from a borehole, the production zone can be fractured to allow the formation fluids to flow more freely from the formation to the borehole. The fracturing operation includes pumping fluids at high pressure towards the formation to form formation fractures. To retain the fractures in an open condition after fracturing pressure is removed, the fractures must be physically propped open, and therefore the fracturing fluids commonly include solid granular materials, such as sand, generally referred to as proppants. Other components of the fracturing fluids typically include water, gel, or other chemical additives.

To pump the fracturing fluids at the high pressures required for fracturing, a series of mechanical pumps having relatively short strokes and relatively high cycles per minute are employed. Such pumps tend to fatigue rather quickly because of the extreme pressures and the high cycles per minute rate of operation. Further aggravating the system is the fracturing fluid itself, which is either abrasive due to the proppant concentration or corrosive due to an acidic concentration or both The intensifiers include hydraulic cylinders that pump the hydraulic fluid down the borehole by being stroked from another cylinder.

To decrease the strain, pumping systems have been designed to have a longer stroke in order to reduce the number of fatigue and wear pressure cycles for longer service life. Pumping rams which receive working fluid through inlets and discharge working fluid through outlets are connected to power rams which receive fluid to affect the forward pumping strokes of the ram assemblies. Such an intensifier also includes a pre-charged accumulator for driving a pair of twin return rams to affect the return strokes of the ram assemblies.

While the long stroke intensifier is an improvement over pumping systems having shorter strokes, as time, manpower requirements, and mechanical maintenance issues are all variable factors that can significantly influence the cost effectiveness and productivity of a fracturing operation, the art would be receptive to improved apparatus and methods for reducing valve cycles and maintenance issues in a fracturing fluid pump.

BRIEF DESCRIPTION

Disclosed herein is a fracturing pump assembly which includes an intensifier including a hydraulic cylinder, a compression member arranged within the hydraulic cylinder and a rotatable member, wherein the compression member is linearly actuated within the hydraulic cylinder by rotation of the rotatable member.

Also disclosed is a method of pressurizing fracturing fluid for delivery to a borehole including rotating a screw rod in a first rotational direction within a hydraulic cylinder, linearly moving a compression member operatively engaged with the screw rod within the hydraulic cylinder. The compression member separates a compression area of the hydraulic cylinder filled with a first fluid from an area of the hydraulic cylinder void of the first fluid and pressurizes the first fluid within the compression area via linear actuation of the compression member in a first axial direction.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
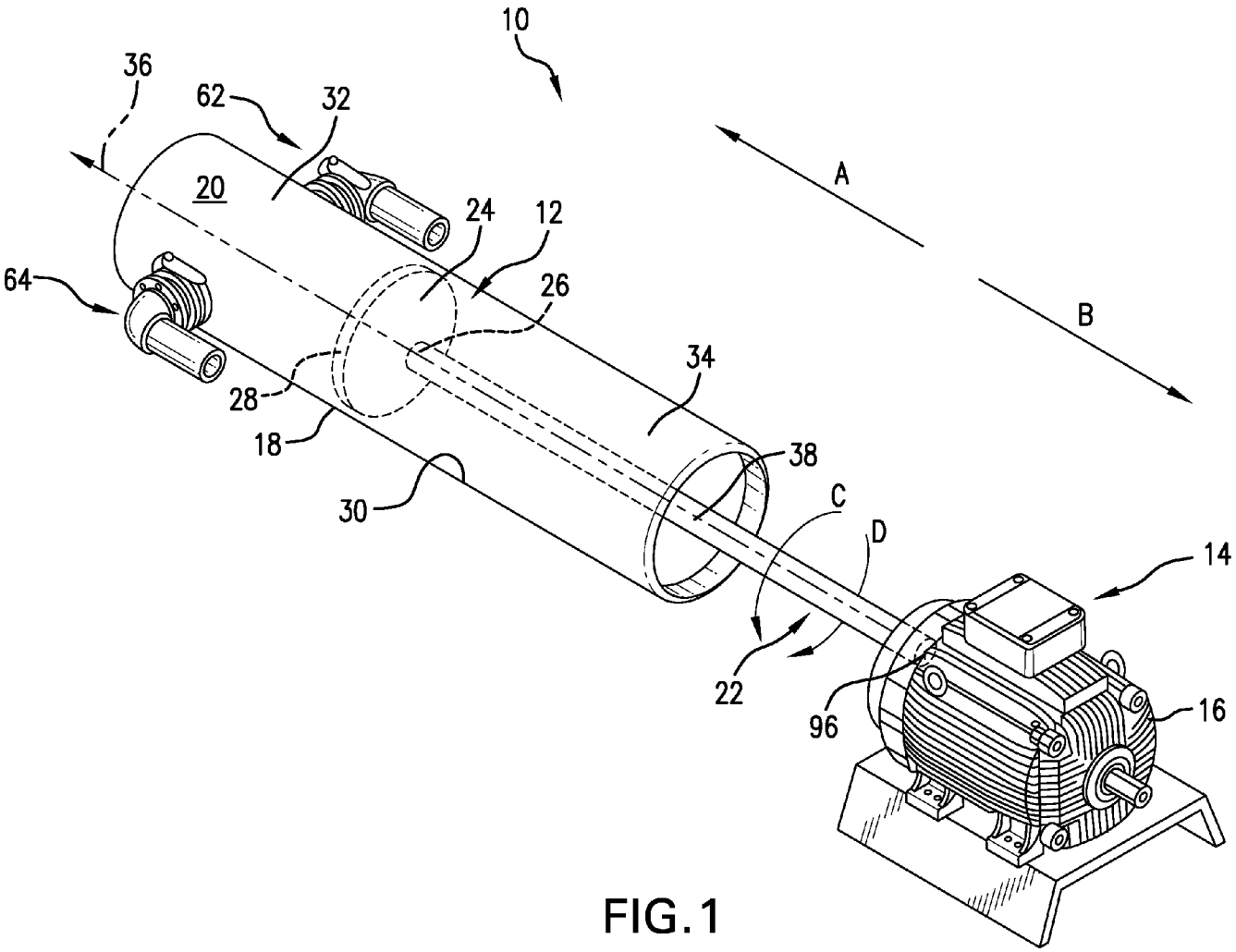
FIG. 1 shows a perspective view of an exemplary embodiment of a fracturing pump assembly including an exemplary intensifier.

With reference to FIG. 1, an exemplary embodiment of a fracturing fluid pump assembly 10, alternately termed a fracturing pump assembly or more simply a frac pump, employs an intensifier 12 actuated by a power source 14. In the illustrated embodiment, the power source 14 is an electric motor 16, although other power sources, motors, engines, and prime movers could alternatively be employed to actuate the intensifier 12. Depending on the location of the electric motor 16 with respect to the intensifier 12, the pump assembly 10 further includes any gearing necessary to enable actuation of the intensifier 12 by the electric motor 16. The intensifier 12 includes a long hydraulic cylinder 18 to pump a fluid 20, such as a fracturing fluid including but not limited to a proppant filled slurry, down the borehole while being pressurized by the intensifier 12. While a conventional fracturing pump assembly utilizes a second cylinder to reciprocatingly stroke within the cylinder 18 in an axial direction of the cylinder 18 via hydraulic pressure, an exemplary embodiment of the pump assembly 10 incorporates a screw mechanism 22, such as a jack screw mechanism or ball screw mechanism, that is turned by the electric motor 16. The use of the screw mechanism 22 reduces valve cycles, thus providing an intensifier 12 requiring reduced valve maintenance.

In an exemplary embodiment, a compression member 24, such as a plate or piston, that at least substantially fills an interior diametrical cross-section of the cylinder 18 is operatively connected to the screw mechanism 22, such as at a first end portion 26 of a rotatable member or screw rod 38. An external periphery 28 of the compression member 24 engages closely with an interior periphery 30 of the cylinder 18 for adequately compressing the fluid 20 within a compression area 32 of the cylinder 18. The compression member 24 entirely or at least substantially separates the compression area 32 of the cylinder 18 from a rod side area 34 of the cylinder 18. As will be understood by a review of FIG. 1, the size of the compression area 32 of the cylinder 18 will decrease when the compression member 24 moves along longitudinal axis 36 in direction A within the cylinder 18 and the size of the rod side area 34 of the cylinder 18 will increase when the compression member 24 moves in direction A. Likewise, the size of the compression area 32 of the cylinder 18 will increase when the compression member 24 moves in direction B, opposite direction A, within the cylinder 18 and the size of the rod side area 34 of the cylinder 18 will decrease when the compression member 24 moves in direction B.

The compression member 24 of the screw mechanism 22 moves in linear directions A, B along the longitudinal axis 36 of the cylinder 18 via screw rod 38 of the screw mechanism 22. The screw rod 38 rotates within the cylinder 18 and the screw mechanism 22 converts the rotational motion of the screw rod 38 to a linear motion of the compression member 24. The screw rod 38 includes a helical thread 60 (FIG. 2) such that rotation of the screw rod 38 in rotational direction C linearly moves the compression member 24 in one of directions A, B, while rotation of the screw rod 38 in opposite rotational direction D linearly moves the compression member 24 in the other of directions A, B. In an exemplary embodiment, rotation of the screw rod 38 of the screw mechanism 22 is accomplished via a mechanical engagement with the electric motor 16. Such mechanical engagement can be direct as shown in FIG. 1, where the screw rod 38 and a rotating output shaft 96 of the electric motor 16 are mechanically configured to interact directly or via gears. Alternatively, in another exemplary embodiment (not shown) power from the electric motor 16 can be delivered to the pump assembly 10 from a remote location and the screw rod 38 is rotated via a gear box which is actuated by the remotely located electric motor 16 or other power source 14.

Figure 2:
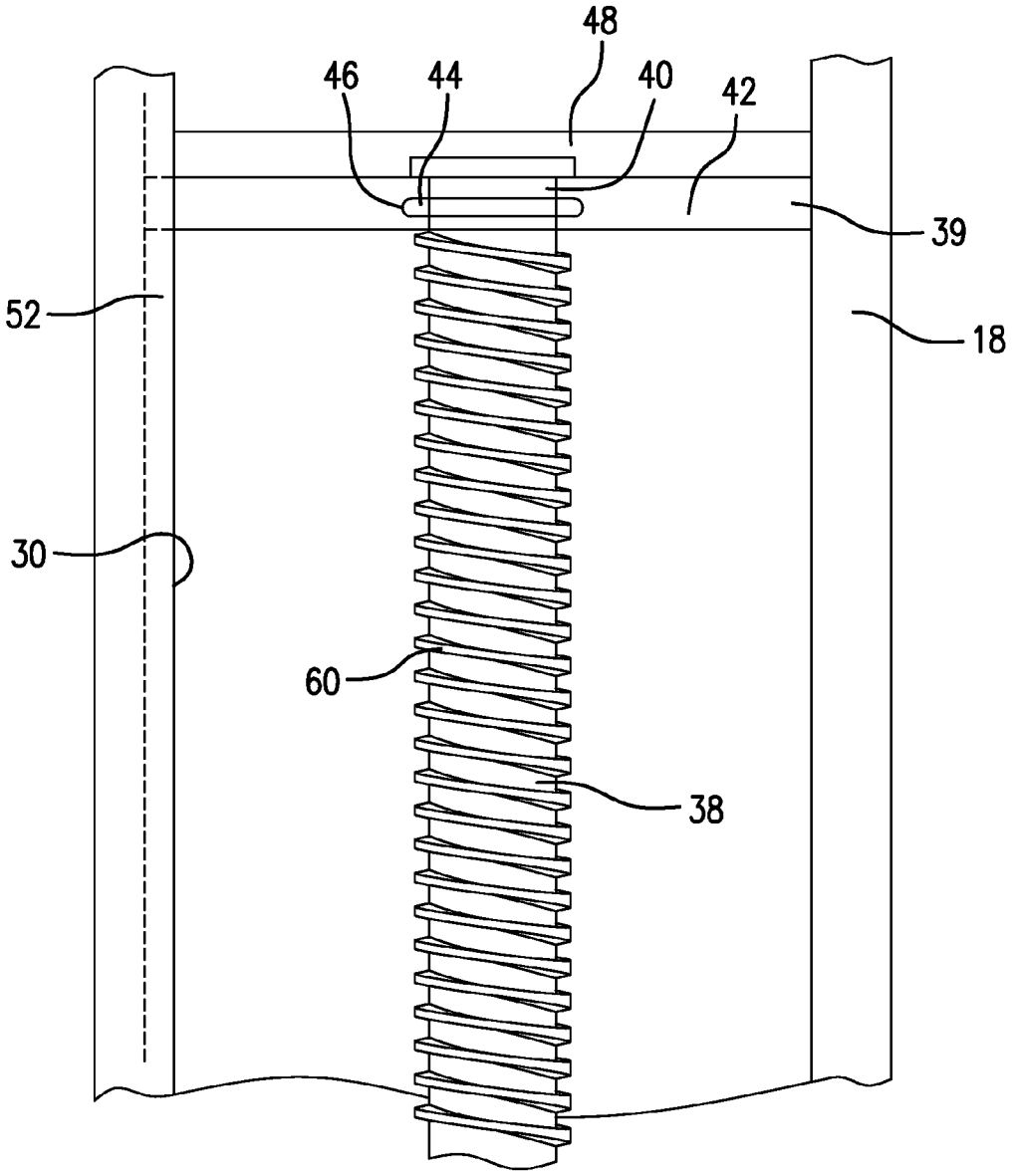
FIG. 2 shows a cross-sectional view of an exemplary intensifier for the fracturing pump assembly of FIG. 1.

In one exemplary embodiment, the compression member 24 can be fixedly attached to the first end portion 26 of the screw rod 38 and rotate within the cylinder 18 with rotation of the screw rod 38. In such an embodiment, the screw rod 38 would also be configured to move linearly within the cylinder 18 upon rotation of the screw rod 38. In another exemplary embodiment, as depicted in FIG. 2, a compression member 39 can include an inner portion 40 rotatably connected to and positioned concentrically within an outer portion 42. An external mating surface 44 of the inner portion 40 cooperates with an internal mating surface 46 of the outer portion 42 to allow for the rotation of the inner portion 40 within the outer portion 42. Ball bearings (not shown) may be disposed between the mating surfaces 44, 46 to reduce friction there between. A fluid engaging plate 48 is disposed on the outer portion 42 and covering the compression member 39 to prevent the fluid 20 contained in the compression area 32 from contacting the working elements of the screw mechanism 22. To prevent the outer portion 42 from rotating with the inner portion 40 and within the cylinder 18, outer mating features 50 of the outer portion 42 can additionally be provided to engage with one or more linear slots 52 or protrusions (not shown) along the interior periphery 30 of the cylinder 18. In such an arrangement, as the screw rod 38 rotates with the inner portion 40, the outer portion 42 only moves linearly within the cylinder 18, and the screw rod 38 rotates with respect to the outer portion 42.

Figure 3:
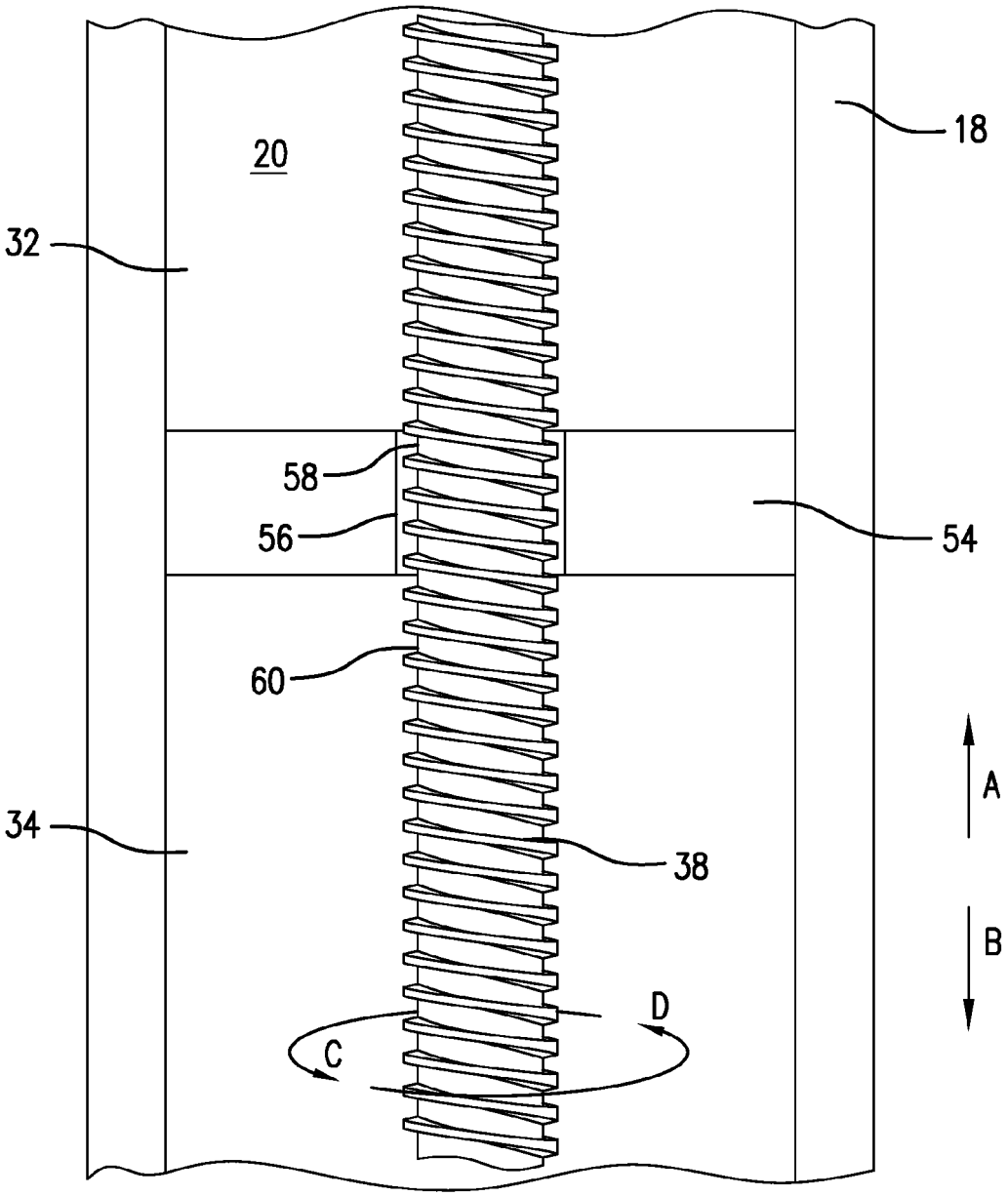
FIG. 3 shows a cross-sectional view of another exemplary intensifier for the fracturing pump assembly of FIG. 1.

In another exemplary embodiment, as shown in FIG. 3, a compression member 54 is arranged as a "traveling nut" on the screw rod 38. The compression member 54 includes a screw receiving aperture 56 having threads 58 to cooperate with threads 60 on the screw rod 38. As in the previous embodiments, the compression member 54 separates a compression area 32 filled with fluid 20 from area 34 of the cylinder 18. In this exemplary embodiment, however, the screw rod 38 occupies at least a portion of the compression area 32. The screw rod 38 is configured to rotate in directions C and D, however only compression member 54 is configured to translate axially in directions A and B. In such an embodiment, since the screw rod 38 rotates but does not move linearly, the screw rod 38 can be connected directly and axially with a rotating output shaft 96 of electric motor 16, as shown in FIG. 1.

Figure 4:
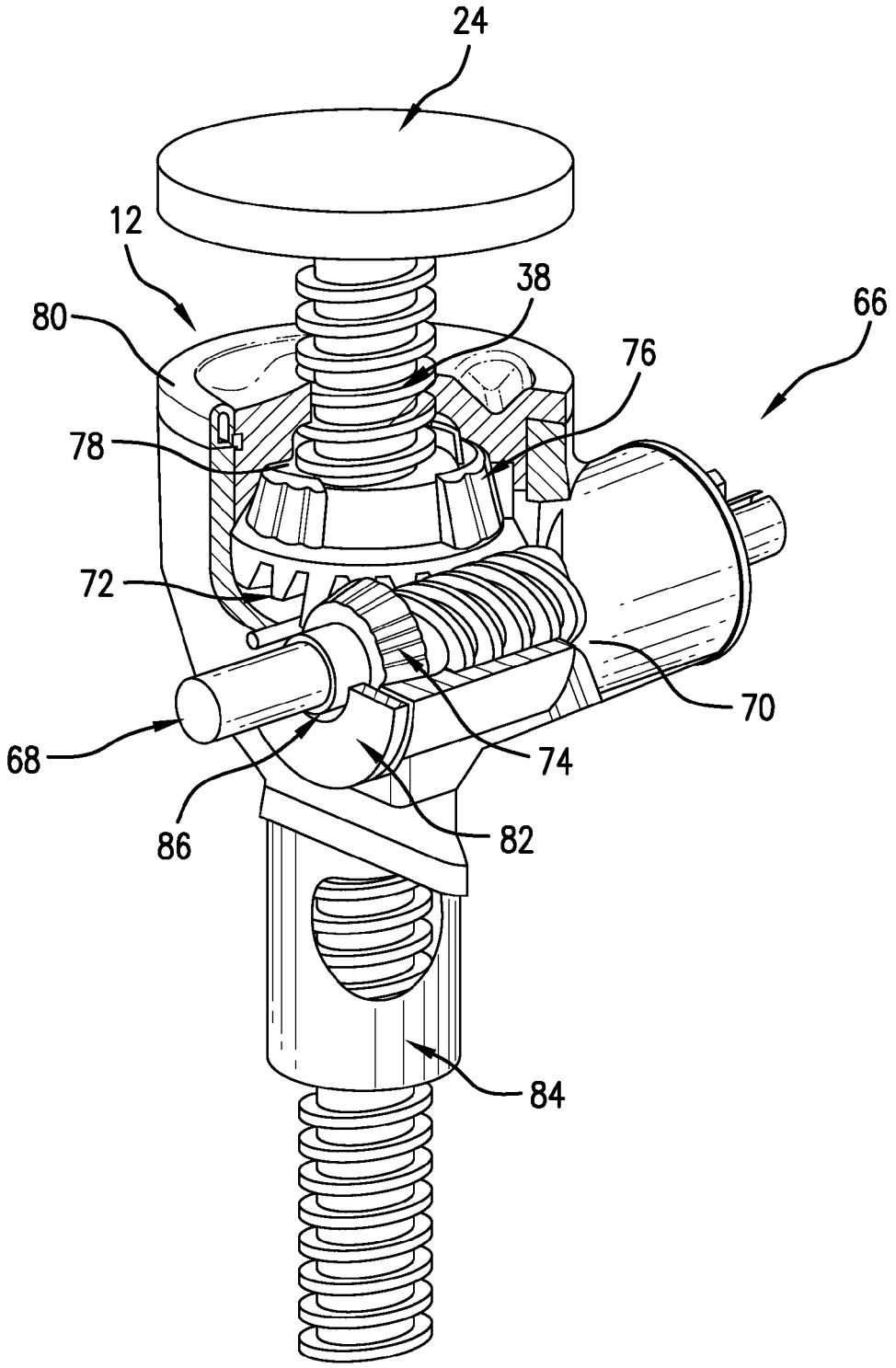
FIG. 4 shows a perspective cut-away view of an exemplary jack screw drive for driving the intensifier of FIG. 1.

FIG. 4 shows an exemplary embodiment of a jack screw mechanism 66 for driving the intensifier 12 of FIG. 1. For clarity, the hydraulic cylinder 18 is not shown. The jack screw mechanism 66 is at least substantially self-locking in that when the compression member 24 is moved in a first axial direction by a rotational force on the screw rod 38 and that rotational force on the screw rod 38 is removed, the screw rod 38 will not rotate in an opposite direction. However, intentional rotational force on the screw rod 38 in an opposite direction allows for movement of the compression member 24 in a second axial direction opposite the first axial direction. The jackscrew mechanism 66 is suitable for large amounts of force, pressure, and weight, and can accommodate varying sizes of intensifiers 12 for the pump assembly 10. The jack screw mechanism 66 is driven by the electric motor 16 shown in FIG. 1 via the input shaft 68 of a worm 70. The worm 70 interacts with a worm gear 72 which in turn rotates the screw rod 38 for moving the compression member 24 in directions A or B as previously described. The worm gear 72 includes a threaded aperture 78 configured to engage and rotate the screw rod 38 to linearly translate the screw rod 38 and compression member 24. Input shaft bearings 74 as well as upper thrust bearing 76 and lower thrust bearing (not shown) may be additionally provided for supporting the input shaft 68 and worm gear 72. Protective housings 80, 82, 84 and seals 86 are additionally provided as necessary to protect working components.

While FIG. 4 depicts the worm gear 72 including threaded aperture 78 configured to engage and rotate the screw rod 38 to linearly translate the screw rod 38 and compression member 24, in an alternative exemplary embodiment, the worm gear 72 is fixedly attached to the screw rod 38 such that rotation of the worm gear 72 rotates the screw rod 38 but does not linearly translate the screw rod 38 within the worm gear 72. Instead, the compression member 24 is arranged as compression member 54 shown in FIG. 3, such that the compression member 54 is linearly translated with respect to screw rod 38.

Figure 5:
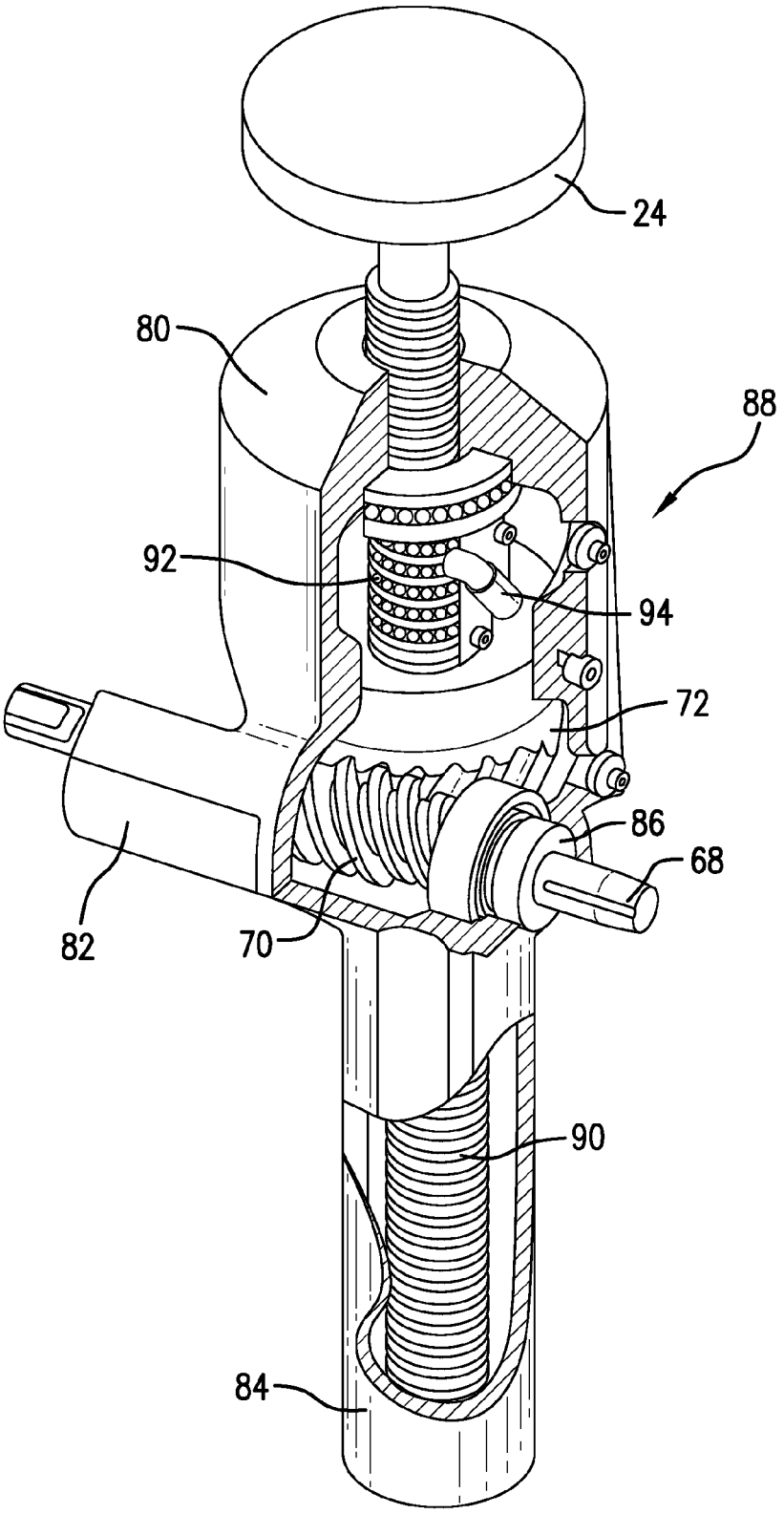
FIG. 5 shows a perspective cut-away view of an exemplary ball screw drive for driving the intensifier of FIG. 1; and, FIG. 6 shows a perspective view of another exemplary embodiment of a fracturing pump assembly including exemplary primary and secondary intensifiers.

In another exemplary embodiment of the intensifier 12, FIG. 5 shows an exemplary ball screw mechanism 88 for driving the intensifier 12 of FIG. 1. To minimize the amount of friction experienced between the sliding contact areas of the worm gear 72 and the screw rod 38 within the jack screw mechanism 66 shown in FIG. 4, the intensifier 12 alternatively includes the ball screw mechanism 66. The ball screw mechanism 88 includes a screw rod 90 different from the screw rod 38 in that the thread profile of the screw rod 90 is semicircular to properly engage with ball bearings 92 of the ball screw mechanism 88. The ball screw mechanism 88 also includes an input shaft 68 engageable with or otherwise rotated by a power source 14, a worm 70, worm gear 72, and a compression member 24. The ball screw mechanism 88 further includes housings 80, 82, 84 and seals 86 as appropriate for a particular application. The ball screw mechanism 88 further includes a ball return 94 configured to direct ball bearings 92 from one end of the ball screw mechanism 88 to the other. The ball screw mechanism 88 is an efficient converter of rotary to linear motion, and is more mechanically efficient than the jack screw mechanism 66 due to reduced friction. The rolling contact of the ball screw mechanism 88 also eliminates or at least substantially reduces stutter when the pump assembly 10 is started or direction is changed, however the ball screw mechanism 88 is also slightly more complicated than the jack screw mechanism 66 and therefore may not be a suitable choice for all applications.

With further reference to FIG. 1, a quantity of fluid 20 to be delivered to the borehole is provided to the compression area 32 of the cylinder 18 by a suction valve 62. When the compression member 24 moves in direction B, the suction valve is opened allowing for entry of the fluid 20 into the compression area 32. When the compression member 24 moves in direction A, a discharge valve 64 is opened allowing for exit of the fluid 20 from the compression area 32. The pressure of the fluid 20 exiting the discharge valve 64 will be greater than the pressure of the fluid 20 entering the compression area 32 via the suction valve 62. The suction and discharge valves 62, 64 can be rated to open and close when certain pressure limits are met.

Figure 6:
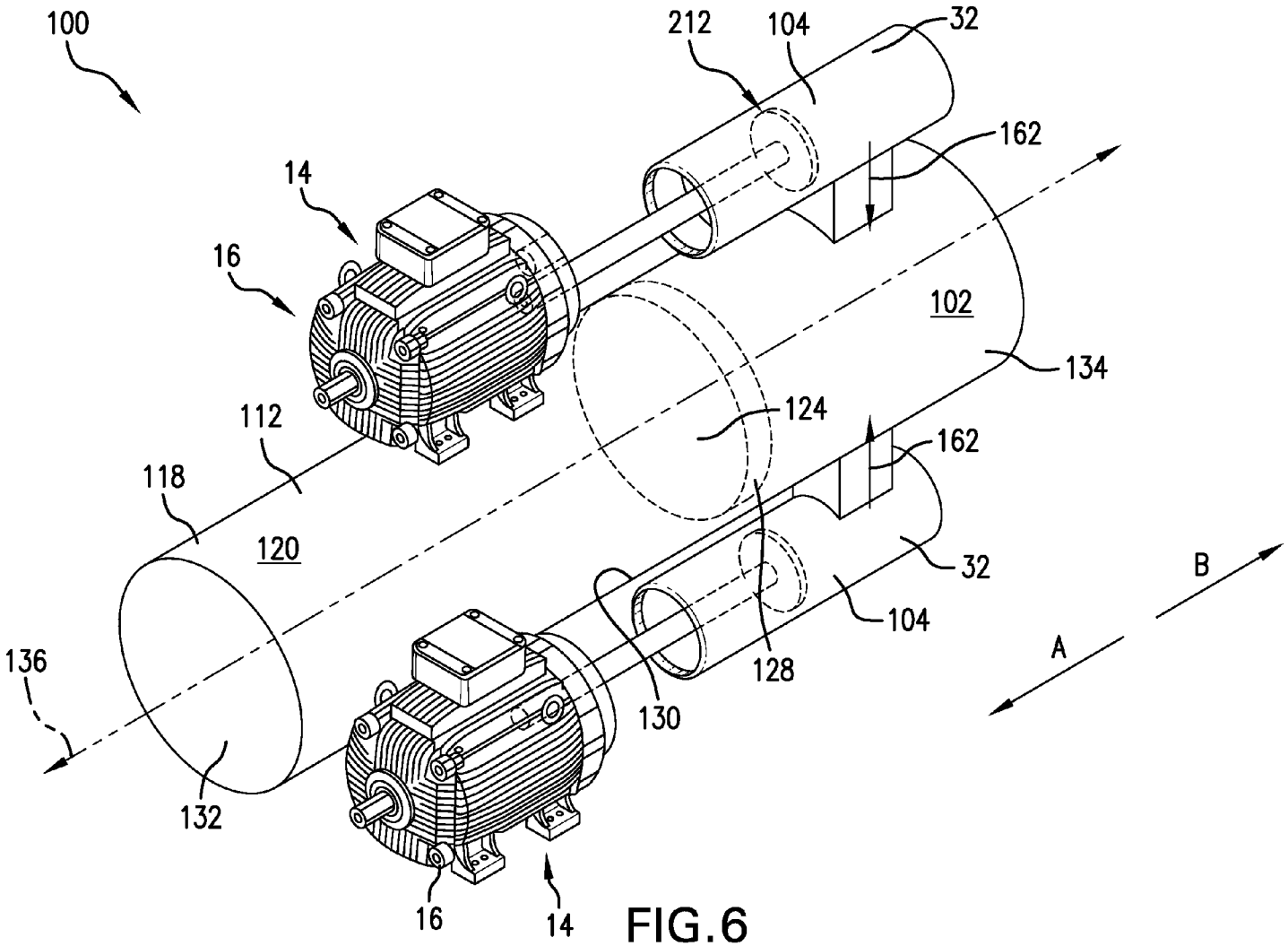

FIG. 6 shows an alternative exemplary embodiment of a fracturing fluid pump assembly 100 including a primary intensifier 112. In this exemplary embodiment, the primary intensifier 112 includes a long hydraulic cylinder 118 to pump a fluid 120, such as but not limited to fracturing fluid and slurry, down the borehole while being pressurized by the intensifier 112. The fluid 120 is pressurized by a hydraulically movable compression member 124 configured to move linearly within the cylinder 118 in directions A or B along longitudinal axis 136 of the hydraulic cylinder 118. The compression member 124 moves via the pressurized force of a fluid 102, such as but not limited to oil. The compression member 124 at least substantially separates a first area 132 of the hydraulic cylinder 118 receiving the fluid 120 from a second area 134 of the hydraulic cylinder 118 receiving the fluid 102. The compression member 124, such as a plate, at least substantially fills an interior diametrical cross-section of the cylinder 118. That is, an external periphery 128 of the compression member 124 engages closely with an interior periphery 130 of the cylinder 118 for adequately compressing the fluid 120 within the first area 132 of the cylinder 118. As will be understood by a review of FIG. 6, the size of the first area 132 of the cylinder 118 will decrease when the compression member 124 moves in direction A within the cylinder 118 and the size of the second area 134 of the cylinder 118 will increase when the compression member 124 moves in direction A. Likewise, the size of the first area 132 of the cylinder 118 will increase when the compression member 124 moves in direction B within the cylinder 118 and the size of the second area 134 of the cylinder 118 will decrease when the compression member 124 moves in direction B.

To increase or decrease the volume of the fluid 102 within the second area 134 of the hydraulic cylinder 118 to affect movement of the compression member 124, the second area 134 is connected to a compression area 32 of one or more secondary intensifiers 212. The secondary intensifiers 212 of FIG. 6 are actuated in a substantially same manner as the intensifier 12 shown in FIG. 1. The secondary intensifiers 212 of the frac pump assembly 100 of FIG. 6, however, do not include the suction and discharge valves 62, 64 shown in FIG. 1. Instead, the pump assembly 100 includes an operable valve 162 between the secondary intensifier 212 and the primary intensifier 112. That is, the valve 162 discharges fluid 104 contained within the compression area 32 to the second area 134 of the hydraulic cylinder 118, and the fluid 104 is the same as the fluid 102, such as oil, instead of a slurry 20 as in the pump assembly 10 of FIG. 1. Although not shown, suction and discharge valves 62, 64 can be provided on the primary intensifier 112 to deliver fluid 120 to and from the first area 132 of the primary intensifier 112. In an exemplary embodiment of the pump assembly 100, the secondary intensifiers 212 are smaller than the primary intensifier 112 such that multiple power sources 14, such as multiple electric motors 16, can be provided. With one power source 14 per secondary intensifier 212, the overall size of each power source 14, secondary intensifier 212, and drive mechanism used in the pump assembly 100 of FIG. 6 can be decreased as compared to the power source 14, intensifier 12, and drive mechanism 66, 88 for a comparable amount of fluid 20, 120 (slurry) pumped to the borehole. The secondary intensifiers 212 can be constructed in a manner similar to any of the exemplary embodiments described above with respect to FIGS. 1-5.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A fracturing pump assembly comprising:

a primary intensifier including:

a primary hydraulic cylinder;

a primary compression member linearly actuable within the primary hydraulic cylinder in opposing first and second directions by a first fluid; and, a plurality of secondary intensifiers in fluid communication with the primary intensifier, each secondary intensifier including:

a secondary hydraulic cylinder;

a secondary compression member arranged within the secondary hydraulic cylinder; and, a rotatable member, wherein the secondary compression member is linearly actuated within the secondary hydraulic cylinder by rotation of the rotatable member;

wherein the first fluid is discharged into the primary hydraulic cylinder by each of the plurality of secondary intensifiers to move the primary compression member in the first direction.

2. The fracturing pump assembly of claim 1, wherein, in each secondary intensifier amongst the plurality of secondary intensifiers, the rotatable member is a screw rod.

3. The fracturing pump assembly of claim 2, further comprising, in each secondary intensifier amongst the plurality of secondary intensifiers, a worm gear configured to rotate the screw rod, and a worm configured to rotate the worm gear.

4. The fracturing pump assembly of claim 1, wherein the primary hydraulic cylinder is larger than each of the secondary hydraulic cylinders.

5. The fracturing pump assembly of claim 1, wherein the primary compression member separates the first fluid from a second fluid within the primary hydraulic cylinder, and the second fluid is a fracturing fluid.

6. The fracturing pump assembly of claim 1 wherein the secondary compression member is rotatable with the rotatable member.

7. The fracturing pump assembly of claim 1, wherein in each secondary intensifier amongst the plurality of secondary intensifiers, the rotatable member rotates with respect to the secondary compression member.

8. The fracturing pump assembly of claim 1, wherein, in each secondary intensifier amongst the plurality of secondary intensifiers, linear movement of the rotatable member is restrained and the secondary compression member is linearly actuated with respect to the rotatable member.

9. The fracturing pump assembly of claim 1, further comprising, in each secondary intensifier amongst the plurality of secondary intensifiers, a power source rotating the rotatable member.

10. The fracturing pump assembly of claim 1, further comprising a valve between each of the secondary hydraulic cylinders and the primary hydraulic cylinder.

11. The fracturing pump assembly of claim 1, further comprising, in each secondary intensifier amongst the plurality of secondary intensifiers, a ball screw mechanism, the rotatable member including semi-circular threads receiving ball bearings of the ball screw mechanism.

12. The fracturing pump assembly of claim 1, wherein, in each secondary intensifier amongst the plurality of secondary intensifiers, the secondary compression member is movable in the opposing first and second directions.

13. The fracturing pump assembly of claim 12, wherein, in each secondary intensifier amongst the plurality of secondary intensifiers, movement of the secondary compression member in the second direction corresponds to movement of the primary compression member in the first direction.

14. A method of pressurizing fracturing fluid for delivery to a borehole, the method comprising:

providing the fracturing fluid within a first area of a primary hydraulic cylinder, a primary compression member separating the fracturing fluid from a first fluid within a second area of the primary hydraulic cylinder;

rotating a screw rod in a first rotational direction within a secondary hydraulic cylinder;

linearly moving a secondary compression member operatively engaged with the screw rod within the secondary hydraulic cylinder, the secondary compression member separating a compression area of the secondary hydraulic cylinder filled with the first fluid from an area of the secondary hydraulic cylinder void of the first fluid;

pressurizing the first fluid within the compression area via linear actuation of the secondary compression member in a first axial direction; and, delivering pressurized first fluid from the compression area of the secondary hydraulic cylinder to the second area of the primary hydraulic cylinder to move the primary compression member in a second axial direction opposite the first axial direction.

15. The method of claim 14 wherein rotating the screw rod includes rotating the screw rod with an electric motor.

16. The method of claim 14, further comprising pressurizing the fracturing fluid with the primary compression member, the fracturing fluid different from the first fluid.

17. The method of claim 14 wherein rotating the screw rod includes rotating a worm configured to rotate a worm gear operatively engaged with the screw rod.

18. The method of claim 14 further comprising rotating the screw rod in a second rotational direction opposite the first rotational direction, rotation of the screw rod in the second rotational direction moving the secondary compression member in the second axial direction.

* * * * *